US009826822B2

(12) United States Patent
Geiberger et al.

(10) Patent No.: US 9,826,822 B2
(45) Date of Patent: Nov. 28, 2017

(54) TOOTHBRUSH

(71) Applicant: GlaxoSmithKline Consumer Healthcare GmbH & Co. KG, Buehl (Baden) (DE)

(72) Inventors: Christoph Geiberger, Königswinter (DE); Wolf-Dieter Mueller, Buehl (DE)

(73) Assignee: GlaxoSmithKline Consumer Healthcare GmbH & Co. KG, Buehl (Baden) (DE)

( * ) Notice: Subject to any disclaimer, the term of this patent is extended or adjusted under 35 U.S.C. 154(b) by 271 days.

(21) Appl. No.: 14/354,203

(22) PCT Filed: Oct. 25, 2012

(86) PCT No.: PCT/EP2012/071100
§ 371 (c)(1),
(2) Date: Apr. 25, 2014

(87) PCT Pub. No.: WO2013/060753
PCT Pub. Date: May 2, 2013

(65) Prior Publication Data

US 2014/0310901 A1 Oct. 23, 2014

(30) Foreign Application Priority Data

Oct. 27, 2011 (GB) ..... 1118603.8
Mar. 16, 2012 (GB) ..... 1204655.3
Jun. 22, 2012 (GB) ..... 1211162.1

(51) Int. Cl.
*A46B 9/04* (2006.01)
*A46B 9/02* (2006.01)
(Continued)

(52) U.S. Cl.
CPC ..... *A46B 9/04* (2013.01); *A46B 5/007* (2013.01); *A46B 9/025* (2013.01); *A46B 9/026* (2013.01);
(Continued)

(58) Field of Classification Search
CPC ..... A46B 9/025; A46B 9/026; A46B 9/04; A46B 9/06; Y10S 15/05; Y10S 15/06
(Continued)

(56) References Cited

U.S. PATENT DOCUMENTS 2,161,349 A * 6/1939 Hadden ..... A46B 9/04 15/106
2,186,005 A * 1/1940 Casto ..... A46B 9/04 15/167.1
(Continued)

FOREIGN PATENT DOCUMENTS

AU 2003276237 A1 11/2003
AU 2003 276 237 B2 10/2010
(Continued)

OTHER PUBLICATIONS

Gao, Fenglin: Human Engineering, 2009, p. 72 (in Japanese).

*Primary Examiner* — Mark Spisich
(74) *Attorney, Agent, or Firm* — Joshua C. Sanders

(57) ABSTRACT

A manual toothbrush having oral hygiene elements arranged in polygons with an oral hygiene element at each apex, and having plural polygons nested within each other. The oral hygiene elements may be bristles, which may be of two different types, or elastomer elements and may contain tooth-polishing additive. The toothbrush head surface may be flat or may have its region distal from the handle angled up.

8 Claims, 5 Drawing Sheets

(51) Int. Cl.
*A46B 5/00* (2006.01)
*A46B 9/06* (2006.01)

(52) U.S. Cl.
CPC ..... *A46B 9/06* (2013.01); *Y10S 15/05* (2013.01); *Y10S 15/06* (2013.01)

(58) Field of Classification Search
USPC ..... 15/110, 167.1, 188, DIG. 5, DIG. 6
See application file for complete search history.

(56) References Cited

U.S. PATENT DOCUMENTS 4,672,706 A * 6/1987 Hill ..... A46B 5/00 15/143.1
5,758,383 A * 6/1998 Hohlbein ..... A46B 5/0025 15/167.1
5,987,688 A 11/1999 Roberts et al.
6,115,870 A * 9/2000 Solanki ..... A46B 9/045 15/167.1
6,178,582 B1 * 1/2001 Halm ..... A46B 5/0025 15/167.1
6,276,021 B1 8/2001 Hohlbein
6,308,367 B1 10/2001 Beals et al.
7,146,675 B2 12/2006 Ansari et al.
7,546,658 B2 * 6/2009 Koeth ..... A46B 5/0025 15/110
2001/0042280 A1 * 11/2001 Moskovich ..... A46B 9/028 15/167.1
2005/0000048 A1 1/2005 Hohlbein
2005/0011031 A1 * 1/2005 Ansari ..... A46B 9/045 15/167.1
2005/0039279 A1 2/2005 Koeth et al.
2006/0248667 A1 11/2006 Kraemer
2008/0307596 A1 12/2008 Hohlbein
2010/0223746 A1 * 9/2010 Mueller ..... A46B 5/0025 15/167.1
2011/0030160 A1 2/2011 Knutzen et al.
2011/0056034 A1 3/2011 Kemp
2011/0061189 A1 3/2011 Meadows et al.
2011/0138560 A1 * 6/2011 Vitt ..... A46B 3/22 15/167.1
2011/0219558 A1 * 9/2011 Vitt ..... A46B 3/22 15/167.1
2014/0338140 A1 11/2014 Ji

FOREIGN PATENT DOCUMENTS

CN 1156574 A 11/1996
CN 1204238 11/1996
CN 101035449 A 10/2005
DE 3247125 * 6/1984
DE 10122987 * 11/2002
FR 2587183 * 3/1987
JP S61-196632 12/1986
JP H09182625 7/1997
JP 2000-23747 * 1/2000
JP 2004-89471 3/2004
JP 2008-142371 * 6/2008
WO WO97/04686 2/1997
WO WO97/16995 5/1997
WO WO97/41753 A1 11/1997
WO WO98/00049 1/1998
WO WO01/26505 4/2001
WO WO 03/030680 A1 4/2003
WO WO2006/044964 4/2006
WO WO 2011/070550 A1 6/2011
WO WO2013/037085 3/2013

* cited by examiner

TOOTHBRUSH

This application is a 371 of International Application No. PCT/EP2012/071100, filed Oct. 25, 2012, which claims the priority of GB Application No. GB 1118603.8 filed Oct. 27, 2011, GB Application No. GB 1204655.3 filed Mar. 16, 2012 and GB Application No. GB 1211162.1 filed Jun. 22, 2012, which are incorporated herein in their entirety.

This invention relates to toothbrushes, especially to manual, i.e. non motor-driven toothbrushes.

Manual toothbrushes are well known devices, generally comprising an elongate handle with a head at one end of the handle, the head and handle defining a toothbrush longitudinal direction (not necessarily a straight line). Typically the head and handle are made of plastic material, or a combination of plastic material and elastomer material, typically thermoplastic elastomer material. Oral hygiene elements extend from a surface of the head in a direction (herein termed the "bristle direction" regardless of the nature of the oral hygiene elements) transverse to this longitudinal direction.

Bristle filaments made typically of polymer such as nylon or PBT arranged in tufts which have an approximately circular envelope as cut across the bristle direction are the most common type of dental cleaning element. It is known e.g. from U.S. Pat. No. 2,186,005 to arrange tufts of bristles in polygons sequentially arranged along the length of the head with the ends of the bristle tufts in a longitudinally undulating profile. WO-A-01/43584 discloses a toothbrush head with nested polygons of bristle tufts.

Another common type of oral hygiene element is an elastomer oral hygiene element, of which many different types are known. For example GB-A-2 040 161 discloses longitudinally extending elastomer strips. GB-A-2 214 420 and WO-A-00/49911 both disclose a toothbrush having a head from which extend small rubber pyramids. GB-A-214 701 discloses a toothbrush having oral hygiene parts comprised of strips of crepe rubber, in one theoretically discussed embodiment of which the strips may have bristles sandwiched between the strips of crepe rubber. EP-A-0 360 766 discloses small rubber cylinders with knobbed ends. U.S. Pat. No. 4,128,910 discloses a toothbrush having rubber oral hygiene parts of various pyramid and ridge shapes. U.S. Pat. No. 4,277,862 discloses a toothbrush having resilient gum massage parts along the outer edges of the bristle pattern. U.S. Pat. No. 4,288,883 discloses rubber cones. U.S. Pat. No. 5,040,260 discloses a toothbrush having a head from which extend small rubber cones. WO-A-96/15696 discloses a toothbrush head provided with strips of a flexible and resilient material, typically a non-elastomeric nylon material, and typically aligned either perpendicular to or parallel to the longitudinal direction. WO-A-96/28994 discloses elastomer bars extending perpendicular to the longitudinal direction and parallel to the edges of the head in combination with bristle "bars" having an elongate cross section cut across the bristle direction, and also discloses a curved rubber "scooping bar" at the tip end of the head. WO-A-97/16995 discloses elastomer "bristles". WO-A-98/18364 discloses tooth polishing pads or finger-like structures. WO-A-99/37181 discloses an outer ring of rubber fingers surrounding an inner dense pack of bristles. WO-A-00/64307 discloses rubber bars with a generally triangular cross section. WO-A-00/76369 discloses elastomeric massaging parts in the form of cylinders. WO-A-01/21036 discloses a longitudinally extending elastomeric wall-like member running for at least half the length of the head. WO-A-03/030680 discloses elastomer oral hygiene elements which have a "V" cross section as cut across the bristle direction. Bristle filaments and elastomer oral hygiene elements are often used in combination.

In such toothbrushes the oral hygiene elements are arranged in various patterns on the surface. WO-A-01/43584 discloses a toothbrush head with bristle tufts arranged in concentric rings. It is known e.g. from U.S. Pat. No. 4,608,968, U.S. Pat. No. 5,735,011, U.S. Pat. No. 6,983,507, U.S. Pat. No. 7,089,621, WO-A-97/41753, WO-A-98/02062, WO-A-2004/026162, WO-A-2004/014182, WO-A-2006/044964, WO-A-2007/038061, and WO-A-2007/149919 to arrange nylon bristle filaments and elastomeric oral hygiene elements in various concentric polygonal arrangements.

It is also known to incorporate a tooth polishing ingredient into tooth cleaning elements such as bristle filaments and elastomer oral hygiene elements. For example EP-A-1538945A discloses perlite, EP-A-0148726 discloses zirconia, U.S. Pat. No. 5,735,011 discloses use of pumice, GB-A-0115289 discloses use of calcium carbonate.

There is an ongoing need in the toothbrush art to explore new technologies and to discover new improved configurations of oral hygiene elements, with the intention of achieving, among other goals, improved tooth cleaning, improved tooth polishing, improved penetration between the teeth, improved gum massage, and improved mouth feel. Other objectives and advantages of this invention will become apparent from the following description.

According to this invention a manual toothbrush is provided comprising an elongate handle with a head at one end of the handle, the head and handle defining a toothbrush longitudinal direction, oral hygiene elements extending from a surface of the head in a bristle direction transverse to this longitudinal direction, characterised in that;

the oral hygiene elements comprise:

either (A) first bristle filaments disposed in tufts having a circular envelope, the tufts being arranged in polygons with a tuft at each apex of the polygon, the polygons being nested together in at least one nest of polygons, plural nests of polygons being arranged sequentially longitudinally on the surface of the head, the surface comprising a surface region proximal to the handle and a surface region distal from the handle the proximal and distal surface regions forming an angle less than 180° between them, two nests being located respectively on the proximal and distal surface regions, or:

(B) first bristle filaments disposed in tufts having a circular envelope, and a second type of oral hygiene element different from the first bristle filaments and being:

either second bristle filaments also disposed in tufts having a circular envelope and having one or more characteristic different from the first bristle filaments selected from a different length, or incorporating an additional tooth-polishing ingredient relative to the first bristle filaments:

or: elastomer oral hygiene elements optionally incorporating an additional tooth-polishing ingredient, and wherein the first bristle filaments and the second type of oral hygiene element are arranged on the surface in respective nested polygons of the oral hygiene elements, with an oral hygiene element at each apex of the polygon, and comprising an outer polygon of first bristle filaments, and an inner polygon of first bristle filaments, and between these outermost and inner polygons an intermediate polygon of the second type of oral hygiene elements.

The above-mentioned arrangements of oral hygiene elements in nested polygons on angled surface regions or made of different materials is believed to provide among other things, one or more of improved tooth cleaning, improved tooth polishing, improved penetration between the teeth, improved gum massage, and improved mouth feel.

The first and second bristle filaments (when present) are disposed in tufts having a circular envelope, meaning that a circumference constructed including the outermost surfaces of the bristle filaments in the tuft is approximately circular. This is typically achieved by mounting the tufts in circular socket holes in the surface in a well known manner. Such tufts may suitably have a cross section dimension as measured across the bristle direction of 0.5-1.1 mm. A preferred cross section dimension is 0.75-0.85 mm. This is less than the typical dimension of ca. 1 mm used for toothbrush bristle tufts and this smaller dimension can assist in penetration between the teeth.

Suitably the first bristle filaments may be made of a polymer such as polyamide (nylon) or polybutylene terephthalate (PBT). Suitably such first bristle filaments do not contain any tooth polishing ingredient in addition to the polymer of which the filament is made. Typically such first bristle filaments may have a length of 9-11 mm, i.e. the typical length of the bristle filaments of prior toothbrushes.

In the embodiment (A) described above, suitably there may be two or three polygons in each of the plural nests. The innermost of the nested polygons may be otherwise empty of tufts, or within the innermost nested polygon there may be one or two tufts of first bristles. Such two tufts may be aligned longitudinally or widthways.

In embodiment (A) one suitable arrangement of the polygons in a nest comprises three polygons nested together with the innermost polygon being otherwise empty of tufts, or within the innermost nested polygon there being one or two tufts of first bristles. Another suitable arrangement of the polygons in a nest comprises two polygons nested together with the innermost polygon being otherwise empty of tufts, or within the innermost nested polygon there being one or two tufts of first bristles.

In embodiment (A) suitably there may be three nests arranged sequentially longitudinally on the surface of the head, with two of the nests on the proximal surface region and one of the nests on the distal surface region forming an angle less than 180° with the proximal surface region.

In embodiment (A) the angle less than 180° is preferably in the range 170-177°, for example 175+/−2°. This angle less than 180° between the proximal and distal regions can be used to cause the tufts on the distal and proximal regions to extend from their respective regions at converging angles, especially if the tufts extend perpendicularly from the surface in the respective distal and proximal regions.

In embodiment (B) the second type of oral hygiene element may be second bristle filaments made of the same polymer material as the first bristle filaments, e.g. nylon or PBT. Alternatively and preferably second bristle filaments are made of a different polymer material to the first bristle filaments. For example first bristle filaments may be made of nylon (polyamide) and second bristle filaments may be made of PBT.

Such second bristle filaments may have a different length from the first bristle filaments. For example second bristle filaments may be shorter than the first bristle filaments, e.g. 1-2 mm shorter. Alternatively second bristle filaments may be longer than the first bristle filaments, e.g. 1-2 mm longer. Longer first or second bristle filaments tend to penetrate between the teeth whilst shorter first or second bristle filaments contact and polish the tooth surfaces.

Additionally or alternatively to such a difference in length, such second bristle filaments may incorporate one or more additional tooth-polishing ingredient relative to the first bristle filaments.

In embodiment (B) the second type of oral hygiene element may be elastomer oral hygiene elements. The forms of elastomer oral hygiene element described above may be suitable. A preferred form of elastomer oral hygiene element is a cylinder (the term as used herein includes shapes with an oval or oblate circular cross section), or a truncated cone in the form of a cylinder gently tapering in the direction away from the head so that the diameter at the end remote from the head is ca. 30-70% of the diameter at the end adjacent to the surface. Typically such a cylinder or truncated cone may have a diameter of 0.7-0.9 mm at its end adjacent to the surface. Such a cylinder or truncated cone suitably has a rounded end. Such elastomer oral hygiene elements may be longer than the first bristle filaments, e.g. 1-2 mm longer.

Suitable elastomer materials for such elastomer oral hygiene elements are thermoplastic elastomer materials of the kind used at present for elastomer oral hygiene elements on toothbrushes. Thermoplastic elastomer materials have the advantage that they can easily be processed and formed into shaped articles by injection moulding, as will be described below. Suitable elastomer materials are the thermoplastic polyester elastomer materials available under the name Hytrel™ with a hardness of Shore D 30-100, especially Shore D 80+/−10.

These elastomer oral hygiene elements may incorporate one or more additional tooth-polishing ingredient.

Suitable additional tooth polishing ingredients, e.g. for the second type of oral hygiene elements, whether these are second bristle filaments or elastomer oral hygiene elements, include known tooth polishing ingredients such as calcium carbonate, silicon dioxide, zirconium oxide, aluminium oxide, zirconium silicate, perlite and pumice. A preferred tooth polishing ingredient is perlite. A suitable grade of perlite is the material Europerl 50™ which is commercially available from Lehmann&Voss Co. (DE). This perlite material is also known as perlite E50. A specification of this perlite material is given in EP 1 538 945 B1 [0030-0032]. A suitable particle size for the tooth polishing ingredient is 0.01-40 microns, preferably 5-30 microns, especially 18+/−3 micron. A suitable loading of the tooth polishing ingredient is 0.2-25 wt %, preferably 3-10 wt %, e.g. ca. 5 wt %.

In embodiment (B) the outer polygon of first bristle tufts may be the outermost oral hygiene elements of a nest of polygons. Alternatively there may be oral hygiene elements more outward than this outer polygon, for example an outermost polygon of oral hygiene elements, being for example either tufts of bristle filaments or elastomer oral hygiene elements. The oral hygiene elements of such an outermost polygon of oral hygiene elements may incorporate one or more additional tooth polishing ingredient as described above.

In embodiment (B), nested within the inner polygon of first bristle filaments may be a single tuft of first or second bristle filaments, or a single elastomer oral hygiene element optionally incorporating an additional tooth-polishing ingredient, suitably at the centre of this more inner polygon. This single tuft or elastomer oral hygiene may have the same or different length as the inner polygon of tufts of bristle filaments.

In embodiment (B), nested within the inner polygon of first bristle filaments may be a more inner polygon of the second type of oral hygiene elements. Nested within this more inner polygon of second type of oral hygiene elements may be a single tuft of first or second bristle filaments, suitably at the centre of this more inner polygon. This single tuft may have the same or different length as the inner polygon of tufts of bristle filaments.

In embodiment (B) the polygons of different types of oral hygiene elements may be combined in various embodiments.

In a first embodiment (B) there may be an outermost polygon of tufts of first bristle filaments, and nested within this outermost polygon of first bristle filaments there may be an inner polygon of tufts of first bristle filaments, and between these two polygons there may be an intermediate polygon of the second type of oral hygiene element. In this embodiment the second type of oral hygiene element may for example be an elastomer oral hygiene element optionally incorporating an additional tooth-polishing ingredient, or a tuft of second bristle filament optionally incorporating an additional tooth-polishing ingredient. Within the inner polygon of tufts of first bristle filaments there may be a single tuft of first bristle filaments.

In a second embodiment (B) there may be an outermost polygon of first bristle filaments, and an inner polygon of first bristle filaments, and between these outermost and inner polygons an intermediate polygon of the second bristle filaments containing additional tooth-polishing ingredient, and within the inner polygon of first bristle filaments there may be an innermost polygon of the second bristle filaments. Within the innermost polygon of tufts of second bristle filaments there may be a single tuft of first bristle filaments.

In a third embodiment (B) there may be an outermost polygon of tufts of first bristle filaments, and nested within this outermost polygon of first bristle filaments there may be an inner polygon of tufts of first bristle filaments, and between these two polygons there may be an intermediate polygon of the second type of oral hygiene element. In this embodiment the second type of oral hygiene element may for example be an elastomer oral hygiene element optionally incorporating an additional tooth-polishing ingredient, or tufts of second bristle filaments optionally incorporating an additional tooth-polishing ingredient. Within the inner polygon of tufts of first bristle filaments there may be a single second type of oral hygiene element, for example a single elastomer oral hygiene element optionally incorporating an additional tooth-polishing ingredient, or a single tuft of second bristle filaments optionally incorporating an additional tooth-polishing ingredient.

Combinations of these embodiments (B) may be used together on a toothbrush head of this invention.

An example of such a combination of embodiments (B) is a combination of plural nests of polygons of the first embodiment.

Another example of such a combination of embodiments (B) is one or more nests of polygons of the first embodiment combined on the toothbrush head with one or more nests of polygons of the second or third embodiment.

Another example of such a combination of embodiments (B) is one or more nests of polygons of the second embodiment combined on the toothbrush head with one or more nests of polygons of the third embodiment.

The respective nests in these combinations of embodiments (B) may be sequentially longitudinally disposed.

In embodiments (A) and (B) the polygons of the oral hygiene elements nested within each other may all be concentric.

In embodiments (A) and (B) the numbers of oral hygiene elements in these respective polygons on any particular toothbrush head of this invention may vary with the size of the toothbrush head, their position on the toothbrush head, the size of the oral hygiene elements and the spacing of the elements around the polygon. For example the toothbrush head may taper in the direction away from the handle, so that less space is available further from the handle.

In embodiment (A) typically an outermost polygon of first tufts in the nest may contain 15-20 tufts. Within such an outermost polygon there may be an inner polygon typically containing 8-14 first tufts. Within such an inner polygon there may be an innermost polygon typically containing 4-8 first tufts.

In embodiment (B) an outer polygon of tufts of first bristle filaments may contain 15-20 tufts, an inner polygon of the second type of oral hygiene elements may contain 10-20 of such elements, and a more inner polygon of tufts of first bristle filaments may contain 3-10 tufts.

In embodiments (A) and (B) the shape of the polygons will be determined by the number of elements in the polygon, e.g. eight elements will form an octagon. A polygon may be regular or irregular in shape. The spacings between oral hygiene elements around a polygon may be uniform, or may be irregular. In the polygons the respective oral hygiene elements may all be at the same distance from the centre of the polygon, or alternatively their distance from the centre may vary. For example around the polygon alternating oral hygiene elements may be at relatively greater or lesser distances from the centre of the polygon. Oral hygiene elements in nested polygons may be radially in line relative to the centre of the nest, or may be circumferentially displaced relative to each other.

In embodiments (A) and (B) the dimensions, e.g. widths of these polygons will depend upon the space available on the toothbrush head, which may be otherwise of a conventional size and shape. Typically the widest polygon may be 10-12 mm across in the toothbrush longitudinal direction or in the toothbrush widthways direction perpendicular to this.

In embodiments (A) and (B) nests of polygons of oral hygiene elements may be located adjacent to each other on the surface, for example longitudinally adjacent to each other. For example the toothbrush head may comprise two or three longitudinally adjacent nests of polygons of oral hygiene elements. Polygons of oral hygiene elements may intersect such that they have oral hygiene elements e.g. tufts of first bristles, tufts of second bristles or elastomer oral hygiene elements in common, e.g. with their outermost, or their outermost and one or more inner polygons in common so that one or more oral hygiene element is part of two polygons.

In embodiments (A) and (B) the oral hygiene elements may extend perpendicular to the surface of the head, or may extend at a non-perpendicular angle to the surface of the head. The oral hygiene elements may all extend in the same direction, or some oral hygiene elements may extend at a converging or diverging angle to the direction in which other oral hygiene elements extend. For example oral hygiene elements relatively closer to the toothbrush handle may extend at a first direction from the surface, e.g. perpendicular to the surface, and oral hygiene elements further from the handle may extend in a second direction which converges with this first direction.

For example in embodiments (A) and (B) the oral hygiene elements may be disposed in three longitudinally disposed nests of polygons, with the elements of the two polygons closest to the handle extending perpendicularly from the surface, and the elements of the polygon furthest from the handle inclined at a non-perpendicular angle to the surface such that the elements lean toward the handle. For example the oral hygiene elements may be disposed in three longitudinally disposed nests of polygons, with the elements of the three nests of polygons extending perpendicularly from the surface, but the part of the surface from which one of the nests of polygons extends may be at a non 180° angle to the part from which the other two nests of polygons extend, so that the oral hygiene elements in the latter one nest of polygons are at a converging angle relative to the orientation of the former two nests of polygons.

In embodiments (A) and (B) the ends remote from the surface of all the oral hygiene elements in a polygon may all be at the same height from the bristle surface, e.g. they may lie in a plane perpendicular to the bristle direction. Alternatively these ends may be at heights such that as viewed transverse to the bristle direction they lie in a curve. For example the ends of longitudinally successive oral hygiene elements may be at distances from the surface which curve or undulate from the bristle surface with longitudinal distance. For example the distance oral hygiene elements, especially those in outermost polygons, extend from the surface may increase sequentially from the oral hygiene elements closest to the longitudinal centerline to the oral hygiene elements widthways opposite each other such that these widthways opposite oral hygiene elements are the highest in the polygon. The ends of the oral hygiene elements remote from the surface may be parallel to the surface, or alternatively they may be profiled, e.g. rounded or domed. If the ends lie in a curve or undulate in height as described above, the ends may be shaped to correspond to this curve or undulation.

In embodiments (A) and (B) the tufts of first and/or second types of bristle filaments of the toothbrush of this invention may be fixed into the surface of the head using conventional techniques such as fastening small metal anchors around the tufts and inserting these anchors plus the tufts into socket holes in the surface. Alternatively the tufts may be moulded into the toothbrush head using the known technique of enclosing the ends of the tufts into the cavity of an injection mould defining the shape of the head and injecting in plastic material around these ends.

Known injection moulding techniques can be used to make elastomer oral hygiene elements, for example enclosing the plastic part of the head in an injection mould cavity defining the shape of the elastomer elements, then injecting in elastomer to thereby form the elements.

A preferred technique for forming the elastomer oral hygiene elements is however to:

(1) make a head plate of a plastic material using injection moulding and including socket holes for tufts of nylon bristle filaments;

(2) enclose this head plate in the cavity of an injection mould defining the shape of the elastomer oral hygiene elements and then inject elastomer material into this cavity to thereby form the elastomer oral hygiene parts;

(3) insert tufts with their ends held by anchors into the socket holes in the bristle plate;

(4) fix, e.g. by welding such as ultrasonically or thermally, the head plate onto the toothbrush head.

Other parts of the toothbrush of this invention may be conventional or incorporate known features, and be made of plastic materials conventional in the art of toothbrushes. For example the handle may include the "V" shaped folded region of EP-A-0 336 641. For example the toothbrush head may incorporate the flexibly-linked tip region of WO-A-9707707. For example the toothbrush may incorporate the resilient flexible link between head and handle of WO-A-9724929. For example the toothbrush may incorporate the combination of resilient flexible link between head and handle and a flexibly-linked tip region in the head, as in WO-A-9837788.

The invention will now be described by way of example only with reference to the accompanying drawings.

FIGS. 3A-3F show a method of manufacture of a head of a toothbrush of embodiment (B) of this invention.

Figure 1:
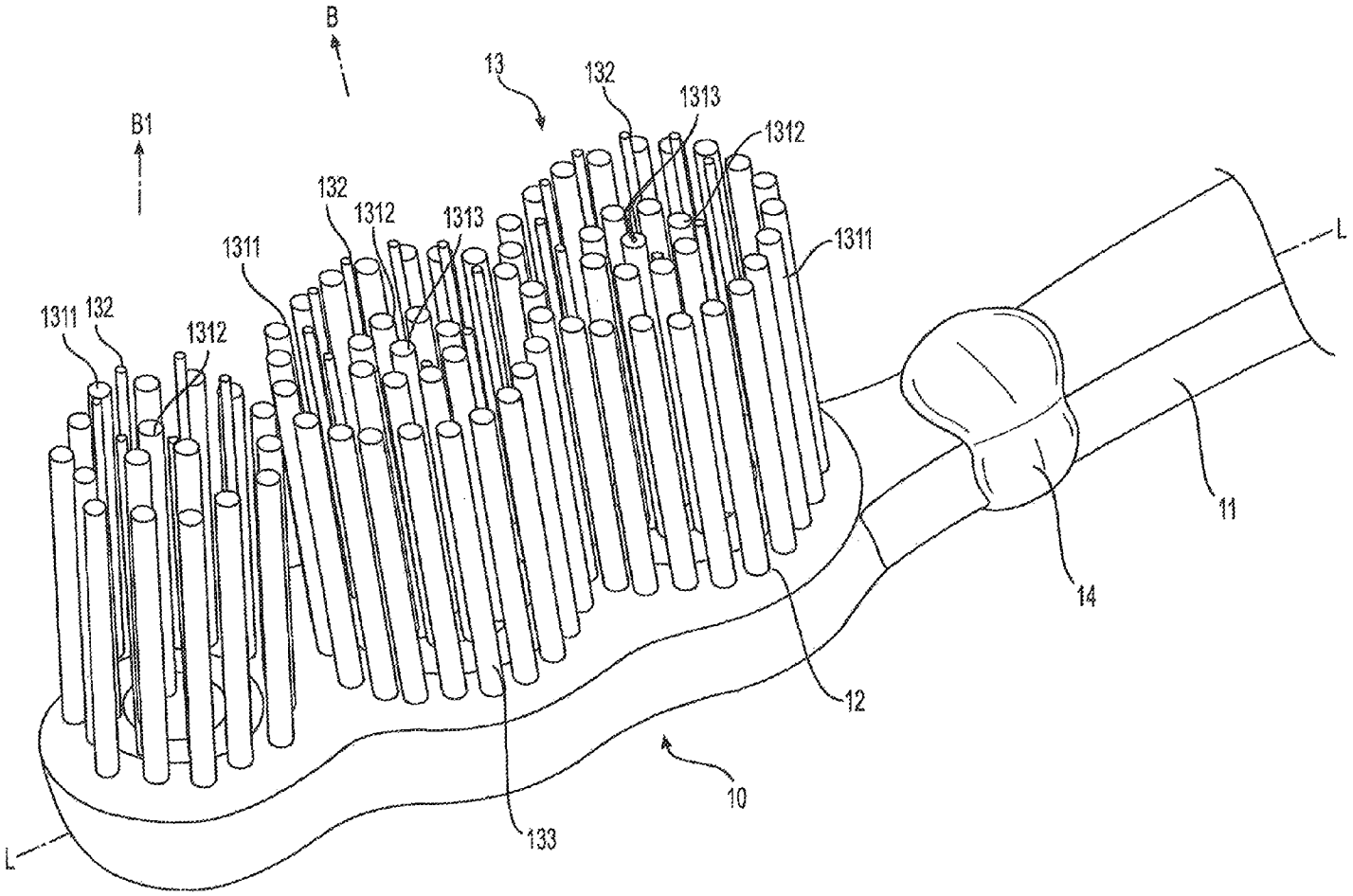
FIG. 1 shows a perspective view of the head of a toothbrush of embodiment (B) of this invention.

Referring to FIG. 1, the head 10 and immediately adjacent part of the handle 11 of a manual toothbrush is shown. The head and handle define a toothbrush longitudinal direction L-L. The head 10 in FIG. 1 has a planar surface 12 from which oral hygiene elements 13 (generally) extend in a bristle direction B transverse to the longitudinal direction L-L. The head 10 has a length and width similar to that of conventional toothbrushes.

The oral hygiene elements are arranged as follows in FIG. 1. First bristle filaments in tufts 1311, 1312 having a circular envelope and second type of oral hygiene elements 132 being elastomer oral hygiene elements are arranged on the surface in respective polygons nested concentrically with an oral hygiene element 1311, 1312, 132 at each apex of the polygon. The oral hygiene elements 1311, 1312, 132 are arranged in the form of an outermost polygon of first bristle filaments 1311, and an inner polygon of first bristle filaments 1312, and between these outermost and inner polygons is nested an intermediate polygon of the elastomer oral hygiene elements 132 incorporating additional tooth-polishing ingredient. Within the inner polygon of first bristle filaments 1312 is a single tuft 132 of first bristle filaments. The polygons of oral hygiene elements 1311, 1312, 132 are concentric, and the tuft 1313 is at the centre of the more inner polygon of tufts 1312. In the toothbrush head shown in FIG. 1 around the polygons alternating outer tufts 1311 of first bristle filaments are at relatively greater or lesser distances from the centre of the polygon.

The tufts 1311, 1312, and 1313 have a circular cross section achieved by mounting the tufts 1311, 1312, 1313 in circular sectioned socket holes 133 in the surface 12 in a well known manner. The tufts 1311, 1312, 1313 have a cross section dimension as measured across the bristle direction B of 0.75-0.85 mm and have a length of 9-11 mm.

The elastomer oral hygiene elements 132 are each in the form of a cylinder gently tapering in the direction away from the surface 12 of head 10 so that the diameter at the end remote from the head 10 is ca. 30-70% of the diameter at the end adjacent to the surface 12. These truncated cones have a diameter of 0.7-0.9 mm at their ends adjacent to the surface 12, and have a rounded end remote from the surface 12. The elastomer oral hygiene elements 132 are 1-2 mm longer than the first bristle filaments in tufts 1311, 1312, 1313.

The first bristle filaments in tufts 1311, 1312, 1313 are made of polyamide (Nylon). The elastomer oral hygiene elements 132 are made of the thermoplastic elastomer material Hytrel™ and incorporate 5-10 wt % of a particulate tooth polishing material selected from pumice, zirconia or perlite with a particle size ca. 6 microns.

In the toothbrush head of FIG. 1 there are three nests of polygons of the oral hygiene elements 1311, 1312, 132 arranged longitudinally along the surface 12. In the nest closest to the end of the head 10 remote from the handle 11 there is no innermost tuft 1313, only an inner polygon 1312 of three tufts of first bristle filaments. The two adjacent nests of oral hygiene elements 1311, 1312, 1313 closest to the handle 11 have some of their outermost polygon of bristle tufts 1311 in common, so that these tufts 1311 are part of both nests.

The numbers of oral hygiene elements 1311, 1312, 1313, 132 present in the nests may be counted from FIG. 1. The polygons may contain more or less oral hygiene elements than shown in FIG. 1.

In the two adjacent nests of oral hygiene elements 1311, 1312, 1313, 132 closest to the handle 11 the oral hygiene elements 1311, 1312, 1313, 132 extend perpendicular to the surface 12 of the head, but in the nest furthest from the handle the bristle direction B1 of the oral hygiene elements 1311, 1312, 132 extend at a non-perpendicular angle to the surface 12 of the head at a converging angle relative to the direction in which the oral hygiene elements 1311, 1312, 1313, 132 of the nests closer to the handle extend.

In FIG. 1 the nest of oral hygiene elements furthest from handle 11 is therefore according to the first embodiment described above, and the two nests closest to the handle 11 are also according to the first embodiment discussed above, with the central tuft 132 at the centre of the nests.

The head 10 is connected to handle 11 via flexible link 14 of known type.

Figure 2:
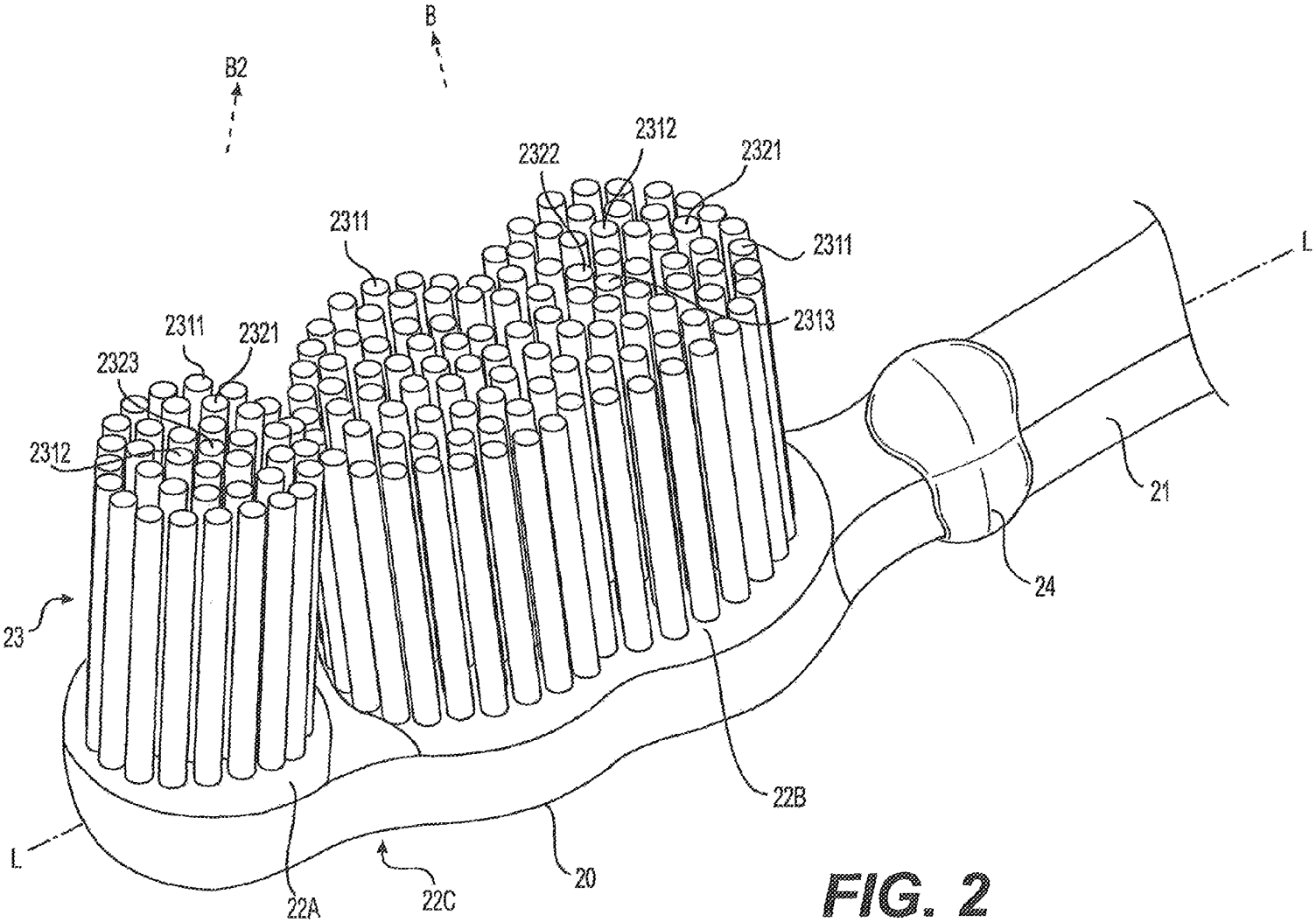
FIG. 2 shows a perspective view of another head of a toothbrush of embodiment (B) of this invention.

Referring to FIG. 2, the head 20 and immediately adjacent part of the handle 21 of a manual toothbrush are shown. The head 20 and handle 21 define a toothbrush longitudinal direction L-L. The head 20 in FIG. 2 has a surface 22A, 22B, of which the part 22A furthest from the handle is angled at a less than 180° angle relative to the part 22B closer to the handle, and linked to the part 22B by a resilient flexible link 22C.

Oral hygiene elements 23 (generally) extend in a bristle direction B transverse to the longitudinal direction L-L. The head 20 has a length and width similar to that of conventional toothbrushes. The head 20 is connected to handle 21 via flexible link 24 of known type.

The oral hygiene elements are arranged as follows in FIG. 2. First bristle filaments in tufts 2311, 2312 having a circular envelope and second type of oral hygiene elements 2321 being second bristle filaments disposed in tufts having a circular envelope and containing an additional tooth-polishing ingredient relative to the first bristle filaments 2311, 2312 are arranged on the surface in respective nests of polygons with an oral hygiene element 2311, 2312, 2321 at each apex of the polygonal nest. The bristle filaments of tufts 2321 and 2322 are made of the same polymer material as the first bristle filaments 2311, 2312, 2313, i.e. nylon, and incorporate known tooth polishing ingredient calcium carbonate at a loading 5-10 wt % and particle size ca. 6 microns. The oral hygiene elements 2311, 2312, 2321 are arranged in the form of an outermost polygon of first bristle filaments 2311, and an inner polygon of first bristle filaments 2312, and between these outermost and inner polygons is nested an intermediate polygon of the tufts 2321 of second bristle filaments.

In the toothbrush head of FIG. 2 there are three nests of polygons of the oral hygiene elements 2311, 2312, 2313 and 2321 arranged longitudinally along the surface 22. Within the inner polygon of tufts 2312 of first bristle filaments of the two nests closest to handle 21 is a more inner polygon 2322 of the second bristle filaments containing the additional tooth-polishing ingredient, and within this more inner polygon 2322 is a single tuft 2313 of first bristle filaments. In the nest closest to the end of the head 20 remote from the handle 21 there is no more inner polygon 2322 of the second bristle filaments, but there is an innermost tuft 2323 of second bristle filaments. The two adjacent nests of oral hygiene elements 2311, 2312, 2313, 2321 and 2322 closest to the handle 21 have some of their outermost tufts 2311 and intermediate polygon of tufts 2321 in common, so that these tufts 2311 and 2321 are part of both nests.

The polygons of oral hygiene elements 2311, 2312, 2321 and 2322 are concentric, and the tuft 2313 is at the centre of the more inner polygon of tufts 2322.

The tufts 2311, 2312, 2313, 2321 and 2322 have a circular cross section achieved by mounting the tufts 2311, 2312, 2313, 2321 and 2322 in circular sectioned socket holes in the surface 22 in a well known manner. The tufts 2311, 2312, 2313, 2321 and 2322 have a cross section dimension as measured across the bristle direction B of 0.75-0.85 mm and have a length of 9-11 mm. The tufts 2321 and 2322 are ca. 1-2 mm shorter than the tufts 2311, 2312 and 2313.

The numbers of oral hygiene elements 2311, 2312, 2321 and 2322 present in the polygons may be counted from FIG. 2. The polygons may contain more or less oral hygiene elements than shown in FIG. 2.

In the three polygons of oral hygiene elements 2311, 2312, 2313, 2321 and 2322 the oral hygiene elements 2311, 2312, 2313, 2321 and 2322 extend perpendicular to the surface 22 of the head. Because the part 22A of surface 22 is inclined at an angle to the part 22B the bristle direction B2 of the oral hygiene elements 2311, 2312, 2321 and 2322 of the polygon on the part 22A extend at a converging angle relative to the direction in which the oral hygiene elements of the polygons closer to the handle 21 extend.

In FIG. 2 the nest of oral hygiene elements furthest from handle 21 is therefore according to the first embodiment described above, and with the single central oral hygiene element 2323. The two nests closest to the handle 21 are according to the second embodiment discussed above, and with the single central oral hygiene element 2313.

Referring to FIG. 3, this schematically shows a method of manufacture of a toothbrush head according to FIG. 1.

Figure 3C:
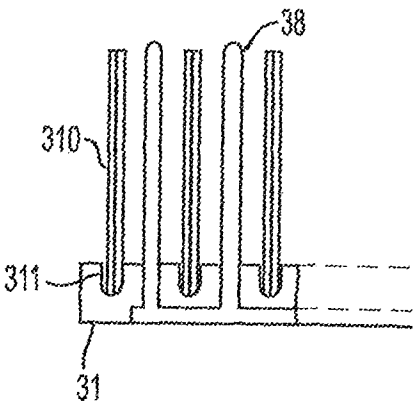
Figure 3B:
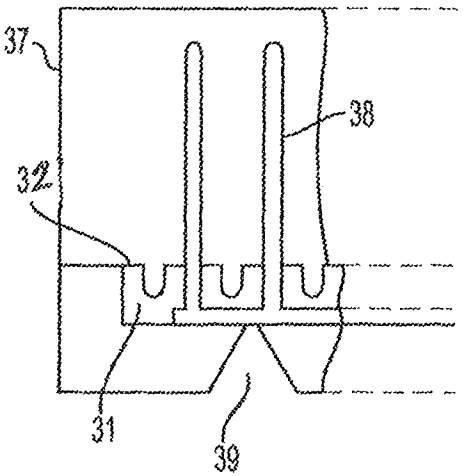
Figure 3A:
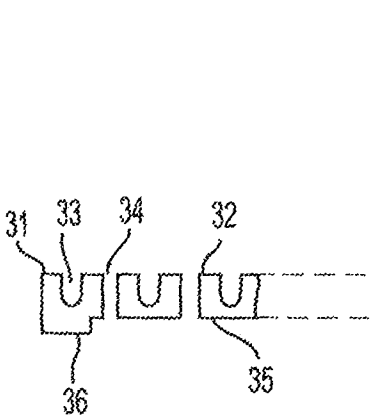
Figure 3D:
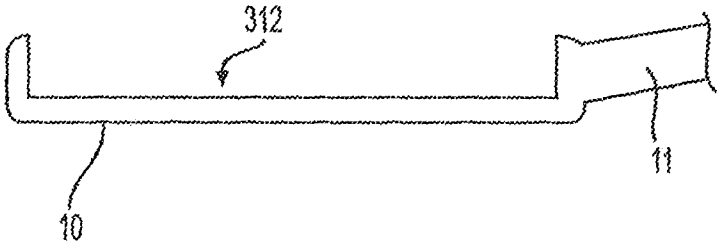
Figure 3E:
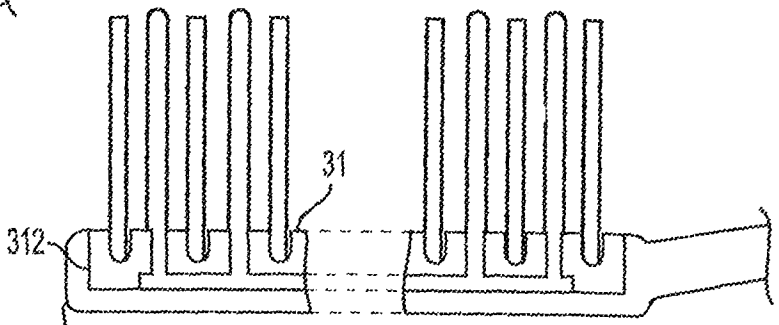

In FIG. 3A, part of a head plate 31 of a plastic material is shown cut in a section along the longitudinal direction of a toothbrush head of which it is to become part. The head plate 31 is made of plastic material such as polypropylene using known injection moulding techniques. The upper surface 32 (as shown) of the head plate 31 corresponds to the surface 12 of the toothbrush head 10 shown in FIG. 1, and in plan view looking down the bristle direction B the shape the surface 32 corresponds to the shape of the surface 12 of FIG. 1. The head plate 31 is made with conventional socket holes 33 for tufts of nylon bristle filaments corresponding to the holes 133 of FIG. 1. The head plate 31 also includes channels 34 formed by means of corresponding cores in the injection mould (not shown) used to make plate 31. The channels 34 are linked by flow channel 35 in the surface 32 of the head plate 31 opposite to surface 32. As seen in FIG. 3B the head plate 31 has been enclosed in the cavity 36 of an injection mould 37 defining the shape of the elastomer oral hygiene elements 38 and then elastomer material has been injected into the cavity 36 via injection port 39 to thereby form the elastomer oral hygiene elements 38. As seen in FIG. 3C tufts of first bristle filaments 310 have been fixed into the socket holes 33 in a conventional manner using small metal anchors 311. As seen in FIG. 3D a toothbrush head 10 and integral handle 11 has been made of plastic material e.g. polypropylene by a conventional injection moulding process, and including a cavity 312 corresponding to the shape of the head plate 31. As seen in FIG. 3E the head plate 31 has been fixed by ultrasonic welding into the cavity 312 to result in the toothbrush head as shown in FIG. 1.

Figure 4:
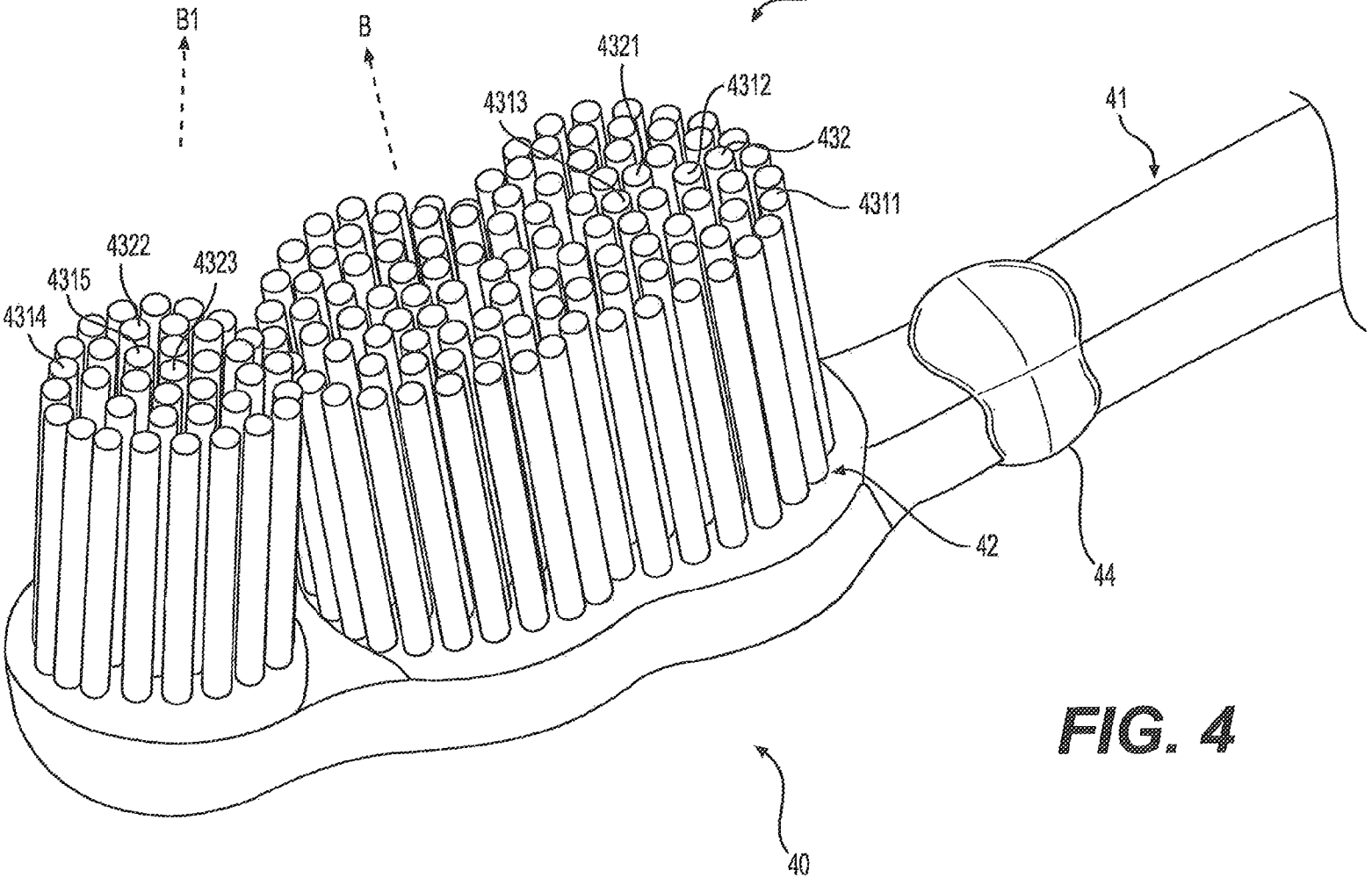
FIG. 4 shows a perspective view of another head of a toothbrush of embodiment (B) of this invention.

Referring to FIG. 4, the head 40 and immediately adjacent part of the handle 41 of a manual toothbrush is shown. The head and handle define a toothbrush longitudinal direction L-L. The head 40 in FIG. 4 has a planar surface 42 from which oral hygiene elements 43 (generally) extend in a bristle direction B transverse to the longitudinal direction L-L. The head 40 has a length and width similar to that of conventional toothbrushes.

The oral hygiene elements are arranged as follows in FIG. 4. First bristle filaments made of nylon and disposed in tufts 4311, 4312, 4313 having a circular envelope and second type of oral hygiene elements 432, 4321 being tufts of second bristle filaments made of PBT and incorporating perlite (Europerl 50™) as a tooth polishing ingredient are arranged on the surface in respective polygons nested concentrically with an oral hygiene element at each apex of the polygon. The tufts 4311, 4312, 4313 432, 4321 have a circular cross section achieved by mounting them in circular sectioned socket holes (not shown) in the surface 42 in a well known manner.

In the toothbrush head of FIG. 4 there are three nests of polygons of the oral hygiene elements arranged longitudinally along the surface 42.

In the two nests of polygons closest to handle 41 the oral hygiene elements 4311, 4312, 432 are arranged in the form of an outermost polygon of first bristle filaments 4311, an inner polygon of first bristle filaments 4312, between these outermost and inner polygons an intermediate polygon of the tufts of second bristle filaments 432, within the inner polygon of first bristle filaments 4312 is an inner polygon of second bristle filaments 4321, and within the centre of this inner polygon 4321 is a single tuft 4313 of first bristle filaments. The polygons of oral hygiene elements 4311, 4312, 432, 4321 are concentric, and the tuft 4313 is at the centre of the more inner polygon of tufts 4321. The two adjacent nests of oral hygiene elements closest to the handle 41 have some of their inner polygon of second bristle tufts 432 in common, so that these tufts 432 are part of both nests.

In the nest of polygons furthest from handle 41 the oral hygiene elements are arranged in the form of an outermost polygon of first bristle filaments 4314, an inner polygon of first bristle filaments 4315, between these outermost and inner polygons an intermediate polygon of the tufts of second bristle filaments 4322, and within the inner polygon of second bristle filaments 4315 is a single tuft 4323 of second bristle filaments. The polygons of oral hygiene elements 4314, 4315, 4322 are concentric, and the tuft 4323 is at the centre of the more inner polygon of tufts 4315.

The numbers of oral hygiene elements 4311, 4312, 4313, 4314, 4315, 432, 4321, 4322 present in the nests may be counted from FIG. 4. The polygons may contain more or less oral hygiene elements than shown in FIG. 4.

The nests of oral hygiene elements extend perpendicular to the surface 42 of the head. The area of the surface 42 from which the nest of oral hygiene elements furthest from the handle extend is at an angle of less than 180° to the area from which the two nests closer to the handle extend, so that the bristle direction B1 of the oral hygiene elements in the nest furthest from the handle is at a converging angle relative to the direction B in which the oral hygiene elements of the two nests closer to the handle 41 extend.

In each of the three nests of oral hygiene elements the tufts of second bristle filaments 432, 4321, 4322, 4323 respectively present in that nest extend to the same height from the surface 42, although the height to which tufts in different nests extend may differ. But in each of the three nests of oral hygiene elements the distance tufts of first bristle filaments 4311 and 4314 in the outermost polygons increases sequentially from the tufts closest to the longitudinal centerline to the tufts widthways opposite each other such that these widthways opposite tufts are the highest.

The head 40 is connected to handle 41 via flexible link 44 of known type.

Figure 5:
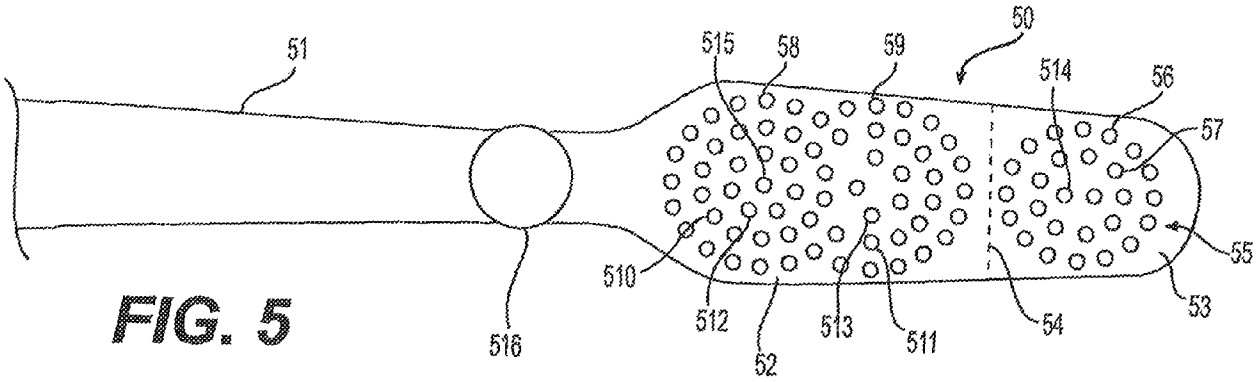
FIG. 5 shows a plan view of the head surface of a toothbrush of embodiment (A) of this invention.
Figure 6:
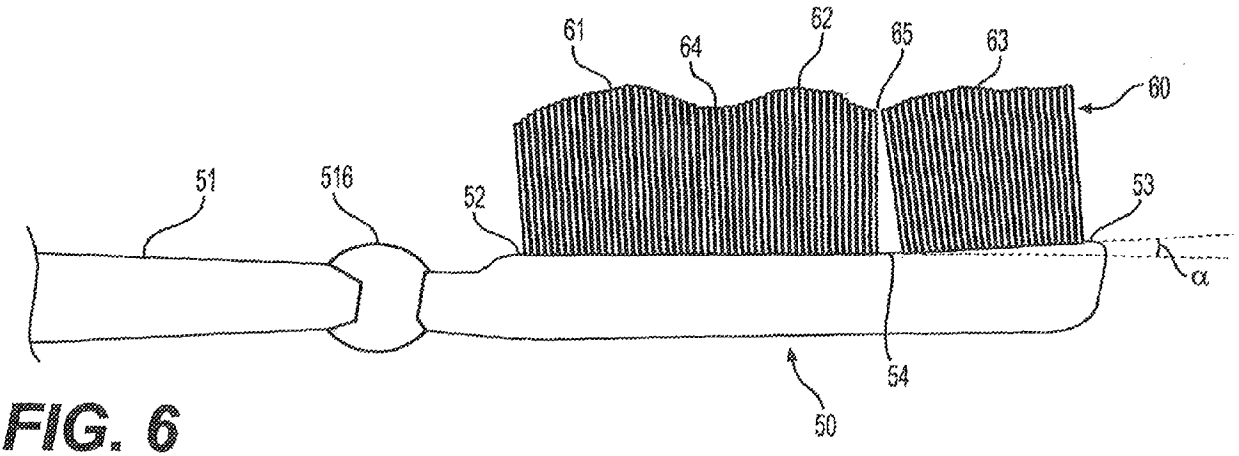
FIG. 6 shows a side view of the head of the toothbrush of FIG. 5.

Referring to FIGS. 5 and 6, the head 50 and immediately adjacent part of the handle 51 of a manual toothbrush is shown. The head and handle define a toothbrush longitudinal direction L-L. The head 50 in FIG. 5 has a surface comprising a surface region 52 proximal to the handle 51 and a surface region 53 distal from the handle 51 the proximal and distal surface regions 52, 53 forming an angle of ca. 175° between them and being divided from each other at the widthways fold line 54 at which the region 53 begins to slope up. The head 50 has a length and width similar to that of conventional toothbrushes.

FIG. 5 shows in plan view the circular sectioned socket holes 55 (generally) in the surface regions 52, 53 in which tufts of bristles (not shown in FIG. 5) may be mounted in a well known manner to thereby form tufts (not shown) with a circular envelope in an arrangement corresponding to holes 55. These holes 55 and consequently the tufts of first bristles are arranged as follows in FIG. 5. In the following description tufts are described as if being in holes 55.

Tufts 56, 57, 58, 59, 510, 511, 512 of first bristle filaments are arranged in polygons with a tuft 56, 57, 58, 59, 510, 511, 512 at each apex. The polygons of tufts 56, 57, 58, 59, 510, 511, 512 are nested together in three nests of polygons. One nest comprises an outermost polygon of tufts 56 and an inner polygon of tufts 57, with two tufts 514 within the inner polygon of tufts 57 and aligned longitudinally, and is located wholly on the surface region 53. Two nests are located on the surface region 52. One of these two nests comprises an outermost polygon of tufts 58, an inner polygon of tufts 510 and an innermost polygon of tufts 512, with a single tuft 515 within the innermost polygon of tufts 512. The other of these two nests comprises an outermost polygon of tufts 59, an inner polygon of tufts 511 and an innermost polygon of tufts 513. The numbers of the tufts present in these polygons may be counted from FIG. 5, but more or less tufts may be present as required.

The polygons of tufts 56, 57, 58, 59, 510, 511, 512 in FIG. 5 are concentric. The two adjacent nests of tufts 58, 59, 510, 511, 512 on surface region 52 closest to the handle 51 have some of their tufts 58, 59, 510, 511, 512 in common, so that these tufts 58, 59, 510, 511, 512 are part of both nests.

FIG. 6 shows a side view of the toothbrush head 50 of FIG. 5. FIG. 6 shows clearly the 175° angle of the region 53 relative to the region 52, i.e. the angle $\alpha$ is 5°. FIG. 6 shows generally 60 the tufts 56, 57, 58, 59, 510, 511, 512, 513, 514, 515 in their three nests as described above, and also shows that the ends of the bristle filaments in tufts 56, 57, 58, 59, 510, 511, 512, 513, 514, 515 are at distances from the surface 52, 53 which undulate with longitudinal distance, rising to rounded peaks 61, 62, 63 corresponding to the nests, with troughs 64, 65 longitudinally in between the peaks 61, 62, 63.

FIG. 6 also shows how the tufts 56, 57, 58, 59, 510, 511, 512, 513, 514, 515 on regions 52 and 53 extend perpendicular from the surface of regions 52 and 53, but as a consequence of the angle of less than 180° between regions 52 and 53, the tufts 56, 57 and 514 of the nest furthest from the handle 51 incline at a non-perpendicular angle to the surface of region 52 such that the tufts 56, 57 and 514 lean toward the handle 51 and extend in a direction which is convergent with the direction in which the tufts 58, 59, 510, 511, 512, 513, 514 extend.

The head 50 is connected to handle 51 via flexible link 516 of known type.

The invention claimed is:

1. A manual toothbrush comprising an elongate handle with a head at one end of the handle, the head and handle defining a toothbrush longitudinal direction, oral hygiene elements extending from a surface of the head in a bristle direction transverse to this longitudinal direction, wherein;

the oral hygiene elements comprise;

bristle filaments disposed in tufts having a circular envelope, the tufts being arranged in polygons with a tuft at each apex of the polygon, the polygons being nested together in at least one nest of polygons, plural nests of polygons being arranged sequentially longitudinally on the surface of the head, the surface comprising a surface region proximal to the handle and a surface region distal from the handle the proximal and distal surface regions forming an angle less than 180° between them, two nests being located respectively on the proximal and distal surface regions;

wherein the length of the bristle filaments varies with longitudinal distance, increasing in length to rounded peaks in the centre of each nest, and decreasing in length to the edge of each nest, giving troughs in between the peaks;

and wherein the tufts have a cross-section dimension of 0.5-1.1 mm.

2. A manual toothbrush according to claim 1 wherein there are two or three polygons in each of the nests.

3. A manual toothbrush according to claim 1 wherein the innermost of the nested polygons is otherwise empty of tufts.

4. A manual toothbrush according to claim 1 wherein within the innermost nested polygon there are one or two tufts of bristles.

5. A manual toothbrush according to claim 1 further comprising three nests of polygons of tufts arranged sequentially longitudinally on the surface of the head, with two of the nests on the proximal surface region and one of the nests on the distal surface region forming an angle less than 180° with the proximal surface region.

6. A manual toothbrush according to claim 5, comprising sequentially longitudinally disposed plural nests of polygons of oral hygiene elements.

7. A manual toothbrush according to claim 5, wherein nests of polygons of oral hygiene elements located longitudinally adjacent to each other on the surface intersect such that they have oral hygiene elements in common.

8. A manual toothbrush according to claim 1, wherein the angle less than 180° is in the range 175+/−2°.

* * * * *